US007047847B2

(12) United States Patent
Chuang

(10) Patent No.: US 7,047,847 B2
(45) Date of Patent: May 23, 2006

(54) TOOLKIT WITH CHAIN TOOL

(76) Inventor: Louis Chuang, 8th Floor-4, No.20, Ta Lon Road, Taichung (TW)

( * ) Notice: Subject to any disclaimer, the term of this patent is extended or adjusted under 35 U.S.C. 154(b) by 77 days.

(21) Appl. No.: 10/929,708

(22) Filed: Aug. 30, 2004

(65) Prior Publication Data

US 2006/0042428 A1 Mar. 2, 2006

(51) Int. Cl.
*B25B 23/00* (2006.01)

(52) U.S. Cl. ..... 81/440; 81/437; 81/439; 7/138

(58) Field of Classification Search ..... 81/440, 81/437, 439; 7/138, 165
See application file for complete search history.

(56) References Cited

U.S. PATENT DOCUMENTS

| | | | | |
|---|---|---|---|---|
| 589,402 | A | 9/1897 | Badgley | |
| 607,599 | A | 7/1898 | Deitsch et al. | |
| 635,562 | A | 10/1899 | Marschütz | |
| 647,528 | A | 4/1900 | Schmidt | |
| 854,891 | A | 5/1907 | Huffman | |
| 1,337,769 | A | 4/1920 | Hemming | |
| 1,369,829 | A | 3/1921 | Minges | |
| 1,378,798 | A | 5/1921 | Kroh | |
| 1,398,583 | A | 11/1921 | Bovee | |
| 1,494,660 | A | 5/1924 | Brandstetter | |
| 1,500,852 | A | 7/1924 | Shephard | |
| 1,556,788 | A | 10/1925 | Hallvarson | |
| 1,801,443 | A | 4/1931 | Mesinger | |
| 2,148,573 | A | 2/1939 | Mulcay | 81/71 |
| 2,173,042 | A | 9/1939 | Picard | 145/50 |
| 2,332,656 | A | 10/1943 | Mirando | 30/22 |
| 2,518,139 | A | 8/1950 | Hallowell et al. | 279/75 |
| 2,798,290 | A | 7/1957 | Bassett | 30/152 |
| 2,804,970 | A | 9/1957 | Kuc et al. | 206/16 |
| 2,828,855 | A | 4/1958 | Mosch | 206/38 |
| 3,061,927 | A | 11/1962 | Von Frankenberg | 30/156 |
| 3,257,991 | A | 6/1966 | Mosch | 120/1 |
| 3,943,801 | A | 3/1976 | Yates | 81/71 |
| 3,964,799 | A | 6/1976 | Knapp | 308/2 R |
| 4,103,378 | A | 8/1978 | Granados | 7/138 |
| 4,204,294 | A | 5/1980 | Halverson | 15/185 |
| 4,238,862 | A | 12/1980 | Leatherman | 7/128 |
| 4,384,499 | A | 5/1983 | Shockley | 81/440 |
| 4,580,469 | A | 4/1986 | Lordahl | 81/437 |
| 4,744,272 | A | 5/1988 | Leatherman | 81/427.5 |
| 4,759,645 | A | 7/1988 | Kuo | 384/396 |
| 4,811,638 | A | 3/1989 | Ketzscher | 81/177.2 |
| 4,836,066 | A | 6/1989 | Graham et al. | 81/177.4 |
| 4,854,045 | A | 8/1989 | Schaub | 30/155 |
| 4,882,841 | A | 11/1989 | Margolis | 30/125 |
| D304,898 | S | 12/1989 | Brawner et al. | D8/26 |
| 4,888,869 | A | 12/1989 | Leatherman | 30/161 |
| 4,908,947 | A | 3/1990 | Schaub | 30/155 |

(Continued)

FOREIGN PATENT DOCUMENTS

| | | |
|---|---|---|
| DE | 9318002 | 11/1993 |

(Continued)

*Primary Examiner*—Joseph J. Hail, III
*Assistant Examiner*—Alvin J Grant
(74) *Attorney, Agent, or Firm*—Alan D. Kamrath; Nikolai & Mersereau, P.A.

(57) ABSTRACT

A toolkit includes a frame, at least one tool set and a chain tool. The tool set is pivotally connected with the frame. The chain tool is attached to the frame in a detachable manner. The chain tool is located in the frame in a manner that it supports the frame.

20 Claims, 7 Drawing Sheets

U.S. PATENT DOCUMENTS 4,967,435 A 11/1990 Seals ..... 7/139
5,062,173 A 11/1991 Collins et al. ..... 7/118
5,140,736 A 8/1992 Hsiao ..... 29/243.54
5,146,815 A 9/1992 Scott, III ..... 81/437
D332,211 S 1/1993 Scott, III ..... D8/105
5,251,341 A 10/1993 Seals ..... 7/138
5,263,389 A 11/1993 Frazzell et al. ..... 81/124.3
5,271,300 A 12/1993 Zurbuchen et al. ..... 81/124.4
5,303,439 A 4/1994 Seals ..... 7/138
5,313,860 A 5/1994 Liou ..... 81/437
5,320,004 A 6/1994 Hsiao ..... 81/440
5,329,834 A 7/1994 Wong ..... 81/58.3
5,385,071 A 1/1995 Her ..... 81/177.7
5,428,853 A 7/1995 Menke et al. ..... 7/138
5,442,982 A 8/1995 Bell ..... 81/439
5,450,774 A 9/1995 Chang ..... 81/440
5,477,758 A 12/1995 Cunningham ..... 81/177.85
5,495,942 A 3/1996 Izhak ..... 81/440
5,553,340 A 9/1996 Brown, Jr. ..... 7/118
5,581,834 A 12/1996 Collins ..... 7/118
5,588,169 A 12/1996 Chuang ..... 7/138
5,592,859 A 1/1997 Johnson et al. ..... 81/177.4
5,632,056 A 5/1997 Hsiao ..... 7/138
D382,180 S 8/1997 Chuang ..... D8/26
5,655,242 A 8/1997 Chuang ..... 7/138
5,669,492 A 9/1997 Chao ..... 206/234
5,685,206 A 11/1997 Ma ..... 81/77
5,711,042 A 1/1998 Chuang ..... 7/138
5,711,194 A 1/1998 Anderson et al. ..... 81/440
D394,952 S 6/1998 Wei ..... D3/273
5,787,535 A 8/1998 Epstein ..... 7/118
5,791,211 A 8/1998 Bondhus et al. ..... 81/440
5,802,936 A 9/1998 Liu ..... 81/450
5,806,380 A 9/1998 Wilsey ..... 81/3.09
D400,775 S 11/1998 Hsu ..... D8/107
D401,133 S 11/1998 Gardiner et al. ..... D8/105
5,842,394 A 12/1998 Hwang ..... 81/490
D406,508 S 3/1999 Rivera ..... D8/52
5,887,306 A 3/1999 Huang ..... 7/165
D408,238 S 4/1999 Rivera ..... D8/52
D410,369 S 6/1999 Yeh ..... D8/55
5,918,513 A 7/1999 Ho ..... 81/490
5,920,935 A 7/1999 Beck ..... 7/128
5,927,162 A 7/1999 Huang ..... 81/177.8
D412,823 S 8/1999 Liao ..... D8/107
5,960,498 A 10/1999 Nabors ..... 7/128
5,970,553 A 10/1999 Lin ..... 7/143
5,970,828 A 10/1999 Bondhus et al. ..... 81/440
6,006,385 A 12/1999 Kershaw et al. ..... 7/129
6,009,582 A 1/2000 Harrison et al. ..... 7/118
6,014,787 A 1/2000 Rivera ..... 7/128
D420,874 S 2/2000 Berg et al. ..... D8/52
D421,377 S 3/2000 Rivera ..... D8/58
6,032,332 A 3/2000 Lin ..... 16/111.1
D423,214 S 4/2000 Hawkins et al. ..... D3/294
6,044,508 A 4/2000 Chuang ..... 7/138
6,047,426 A 4/2000 McIntosh et al. ..... 7/129
6,047,619 A 4/2000 Anderson et al. ..... 81/440
6,065,213 A 5/2000 Rivera ..... 30/155
6,076,665 A 6/2000 Chuang ..... 206/234
D427,496 S 7/2000 Berg ..... D8/52
D427,501 S 7/2000 Berg et al. ..... D8/105
D427,868 S 7/2000 Rivera ..... D8/52
D427,875 S 7/2000 Chiu ..... D8/105
6,092,444 A 7/2000 Hsiao ..... 81/440
RE36,797 E 8/2000 Egert et al. ..... 81/438
D428,791 S 8/2000 Anderson et al. ..... D8/107
D429,131 S 8/2000 Rivera ..... D8/58
D429,132 S 8/2000 Rivera ..... D8/58
D429,616 S 8/2000 Rivera ..... D8/105
D429,621 S 8/2000 Rivera ..... D8/343
D429,989 S 8/2000 Rivera ..... D8/105
6,112,351 A 9/2000 Hawkins et al. ..... 7/138
6,119,560 A 9/2000 Anderson et al. ..... 7/168
6,128,805 A 10/2000 Rivera ..... 16/111.1
6,128,981 A 10/2000 Bondhus et al. ..... 81/440
D433,902 S 11/2000 Rivera ..... D8/52
6,151,998 A 11/2000 Fu-Hui ..... 81/490
6,151,999 A 11/2000 Eklind ..... 81/440
6,161,273 A 12/2000 Rivera et al. ..... 29/525.06
D436,514 S 1/2001 Rivera ..... D8/105
D437,541 S 2/2001 Hermansen et al. ..... D8/105
D440,141 S 4/2001 Yeh ..... D8/105
6,216,301 B1 4/2001 Rivera ..... 7/128
6,220,127 B1 4/2001 Berg et al. ..... 81/427.5
RE37,210 E * 6/2001 Chuang ..... 7/138
6,243,902 B1 6/2001 Huang ..... 7/165
6,286,168 B1 * 9/2001 Woodruff et al. ..... 7/138
6,286,397 B1 9/2001 Taggart et al. ..... 81/63.1
6,311,587 B1 11/2001 Johnson et al. ..... 81/177.4
6,352,010 B1 3/2002 Giarritta et al. ..... 81/177.4
D459,967 S 7/2002 Johnson et al. ..... D8/71
6,490,954 B1 12/2002 Johnson et al. ..... 81/177.4
6,520,053 B1 2/2003 Liao ..... 81/177.9
6,520,054 B1 2/2003 Wang ..... 81/440
6,564,678 B1 5/2003 Wang ..... 81/124.4
D476,215 S 6/2003 Chuang ..... D8/105
6,574,817 B1 * 6/2003 Wu ..... 7/138
6,601,481 B1 8/2003 Chuang ..... 81/440
6,622,329 B1 9/2003 Ostor et al. ..... 7/138
6,640,675 B1 11/2003 Chuang ..... 81/490
6,751,819 B1 6/2004 Chuang ..... 7/100

FOREIGN PATENT DOCUMENTS

| | | |
|---|---|---|
| EP | 0191913 | 11/1985 |
| FR | 525527 | 10/1920 |
| FR | 787512 | 3/1935 |
| FR | 1361926 | 2/1963 |
| GB | 856223 | 12/1960 |
| WO | WO 8301406 | 4/1983 |
| WO | WO 9729887 | 8/1997 |

* cited by examiner

TOOLKIT WITH CHAIN TOOL

FIELD OF INVENTION

The present invention relates to a toolkit that includes a chain tool for removing a pin from a link of a chain.

BACKGROUND OF INVENTION

Referring to FIG. 7, a conventional toolkit includes a frame 110 with two lateral members 111 and two bolts 121 extending between the lateral members 111. A tool set 120 is pivotally connected with each of the bolts 121. A chain tool includes a holder 123 hung on one of the bolts 121 and a screw 124 installed on the holder 123. The toolkit includes a crowbar 130 and an Allen key 132 extending from the crowbar 130. In use, a link of a chain is held on the holder 123. The Allen key 132 is fit in a recess defined in the screw 124. The crowbar 130 is rotated in order to rotate and move the screw 124 on the holder 123. Thus, a pin is pushed from the link of the chain so that the link can be removed from the chain. Drawbacks have been encountered in using this conventional toolkit. Firstly, the chain tool cannot support the frame 110. Secondly, the chain tool occupies some space on the bolts 121 that would otherwise encompass one or more tools. Thirdly, the chain tool cannot be taken from the frame 110 in order to reduce the total weight of this conventional toolkit if the chain tool is not to be needed.

The present invention is therefore intended to obviate or at least alleviate the problems encountered in the prior art.

SUMMARY OF INVENTION

According to the present invention, a toolkit includes a frame, at least one tool set and a chain tool. The tool set is pivotally connected with the frame. The chain tool is attached to the frame in a detachable manner. The chain tool is located in the frame in order to support the frame. The primary advantage of the toolkit of the present invention is the support for the frame by the chain tool.

Other objects, advantages and novel features of the present invention will become more apparent from the following detailed description referring to the drawings.

BRIEF DESCRIPTION OF DRAWINGS

The present invention will be described via detailed illustration of the preferred embodiment referring to the drawings.

DETAILED DESCRIPTION OF PREFERRED EMBODIMENT

Figure 1:
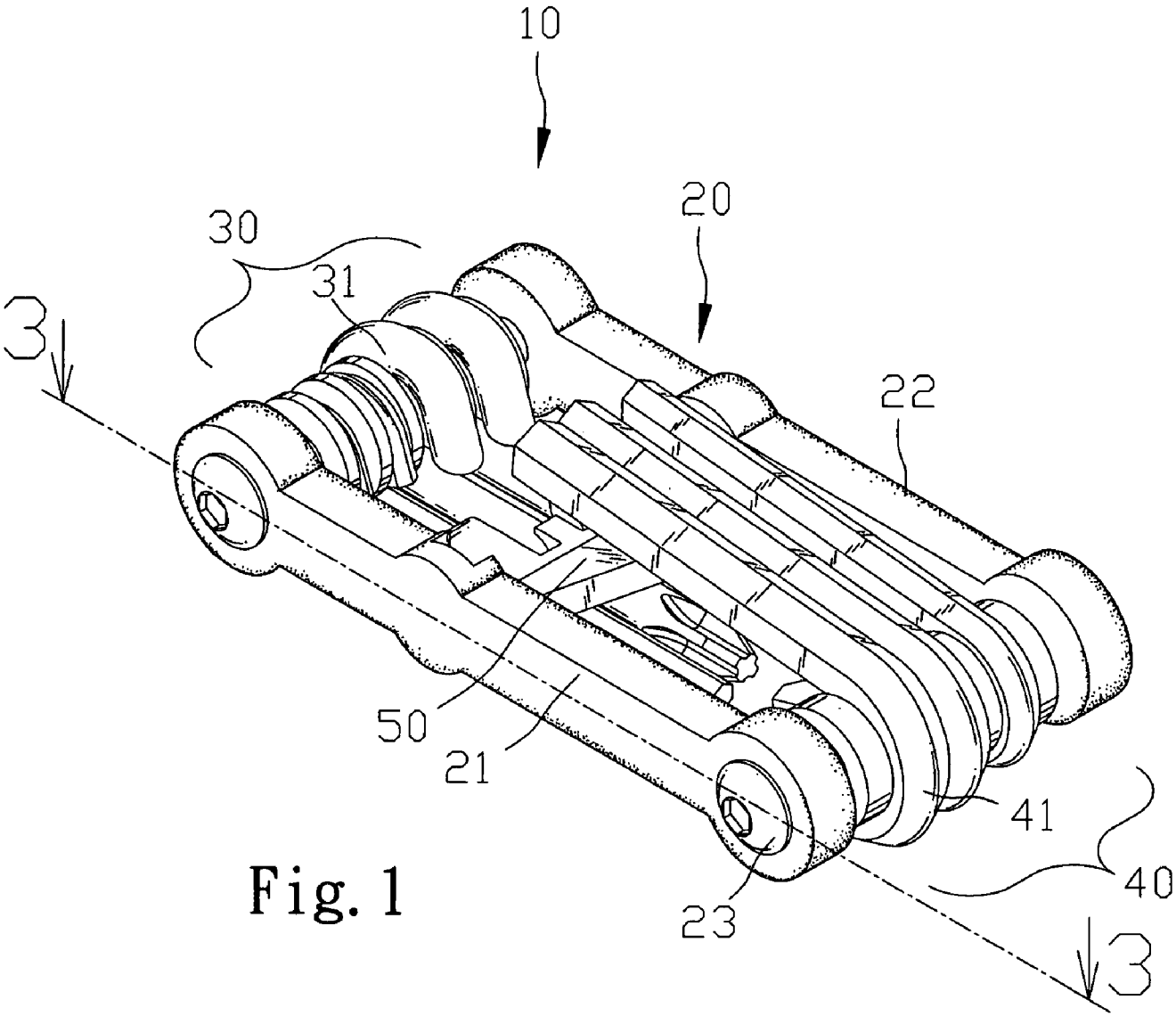
FIG. 1 is a perspective view of a toolkit with a chain tool for removing a pin from a link of a chain according to the preferred embodiment of the present invention.

Referring to FIG. 1, a toolkit 10 includes a frame 20, a first tool set 30, a second tool set 40 and a chain tool according to the preferred embodiment of the present invention.

Figure 2:
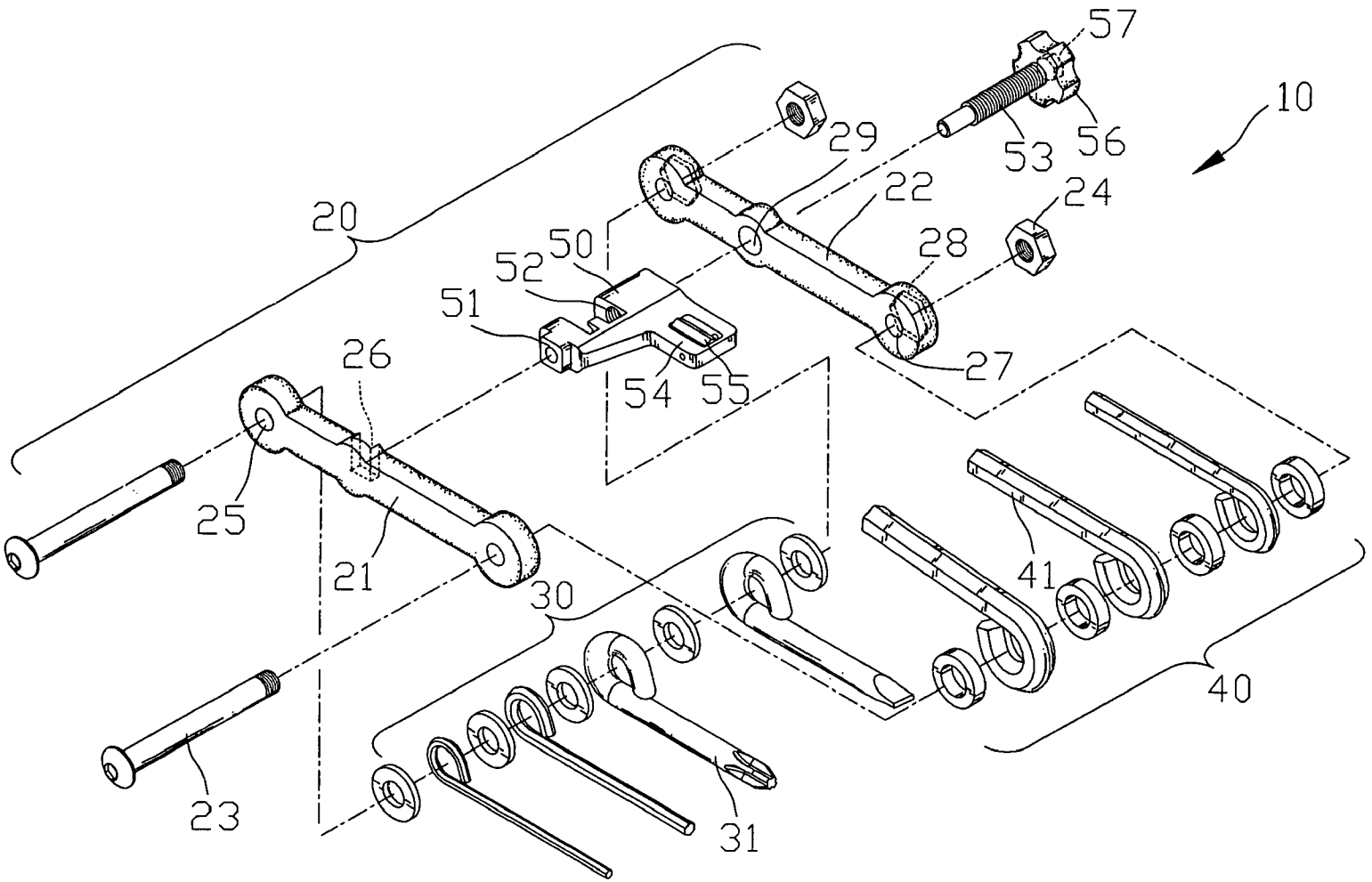
FIG. 2 is an exploded view of the toolkit shown in FIG. 1.

Referring to FIG. 2, the frame 20 includes a first side or lateral member 21, a second side or lateral member 22, two bolts 23 extending between the first lateral member 21 and the second lateral member 22 and two nuts 24 engaged with the bolts 23. The first lateral member 21 includes two apertures 25 each defined in an end thereof and a recess 26 defined in a side thereof. The second lateral member 22 includes two apertures 27 each defined in an end thereof, two recesses 28 each communicated with related one of the apertures 27 and an aperture 29 defined in a center thereof. Each of the nuts 24 is fit in related one of the recesses 28 in a non-rotational manner. Each of the bolts 23 is inserted through related one of the apertures 25 and related one of the apertures 27.

The first tool set 30 includes a plurality of tools 31 each including a looped end in which one of the bolts 23 is inserted. Thus, the tools 31 are pivotally connected with the frame 20.

The second tool set 40 includes a plurality of Allen keys 41 each including a looped end in which the other of the bolts 23 is inserted. Thus, the Allen keys 41 are pivotally connected with the frame 20.

The chain tool includes a holder 50 and a screw 53. The holder 50 includes a block 51 formed thereon, a screw hole 52 defined therein, a handle 54 formed thereon and an Allen key 55 pivotally connected with the handle 54. A knob 56 is secured to the screw 53 so that the knob 56 can be operated in order to rotate the screw 53. A recess 57 is defined in the knob 56.

Figure 3:
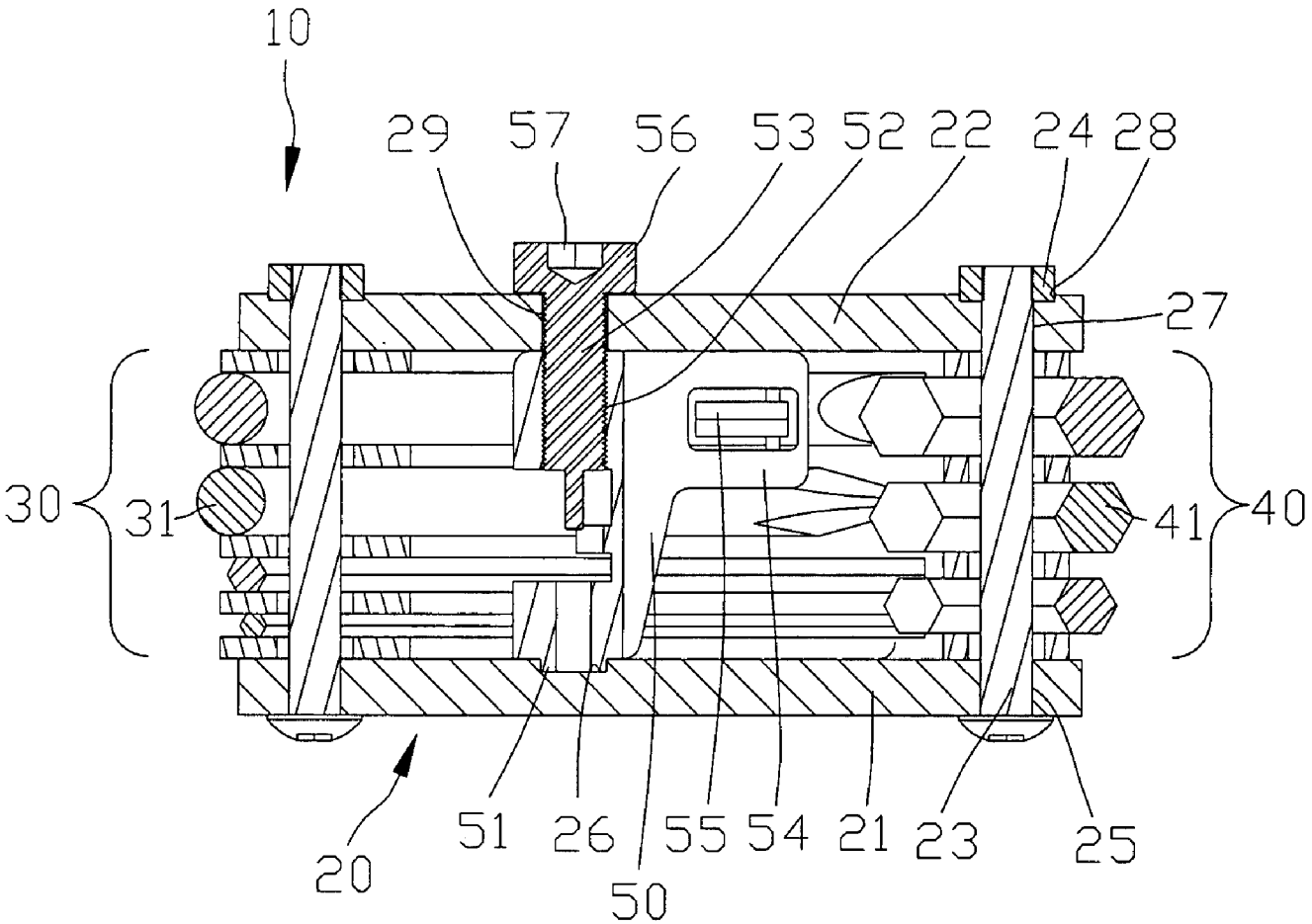
FIG. 3 is a cross-sectional view of the toolkit taken along line 3—3 shown in FIG. 1.

Referring to FIG. 3, the block 51 is put in the recess 26. The screw 53 is driven in the screw hole 52 through the aperture 29. The chain tool keeps the first lateral member 21 from the second lateral member 22. When held tightly, the frame 20 is not deformed because of the chain tool that keeps the first lateral member 21 from the second lateral member 22.

Figure 4:
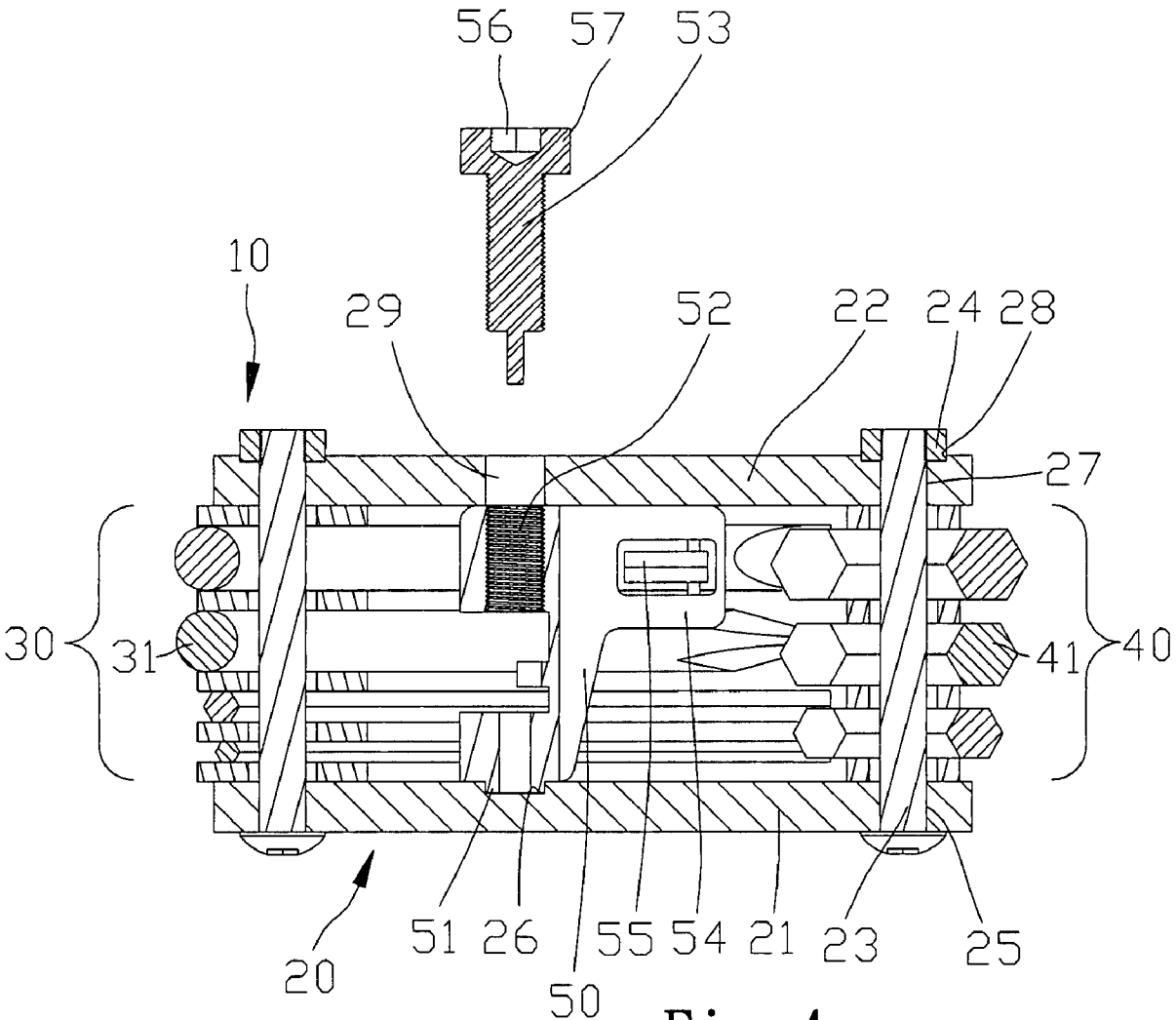
FIG. 4 is similar to FIG. 3 but shows the toolkit in another position.

Referring to FIG. 4, the screw 53 is removed from the screw hole 52. At this instant, the holder 50 can be easily removed from the frame 20.

Figure 5:
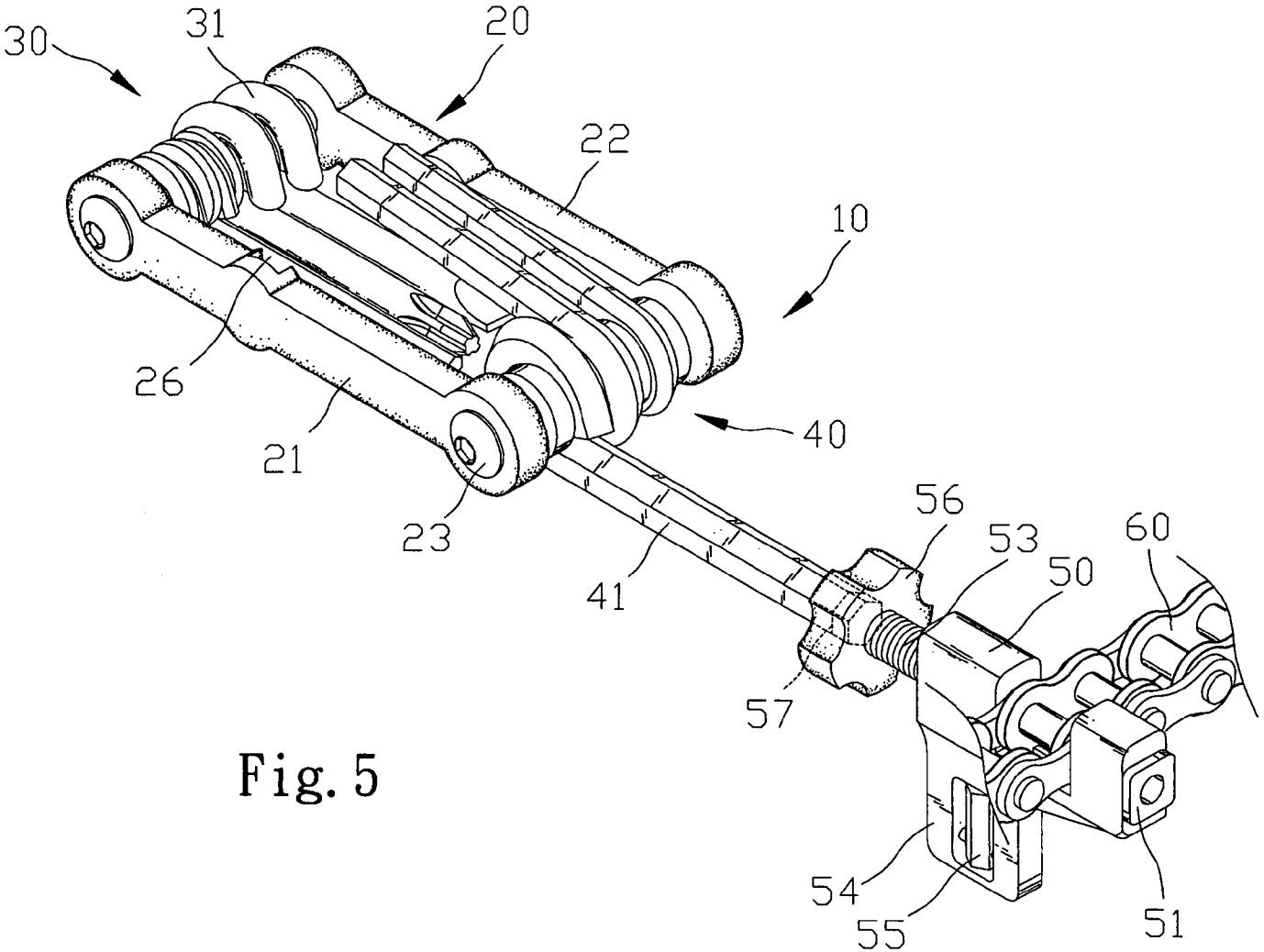
FIG. 5 is similar to FIG. 1 but shows the toolkit in another position.

Referring to FIG. 5, a link of a chain 60 is held on the holder 50. The knob 56 is twisted in order to rotate and move the screw 53 on the holder 50. One of the Allen keys 41 is inserted in the recess 57. This Allen key 41 can be twisted in order to further rotate and move the screw 53 on the holder 50. Thus, a pin is pushed from the link of the chain 60. Hence, the link can be removed from the chain 60.

Figure 6:
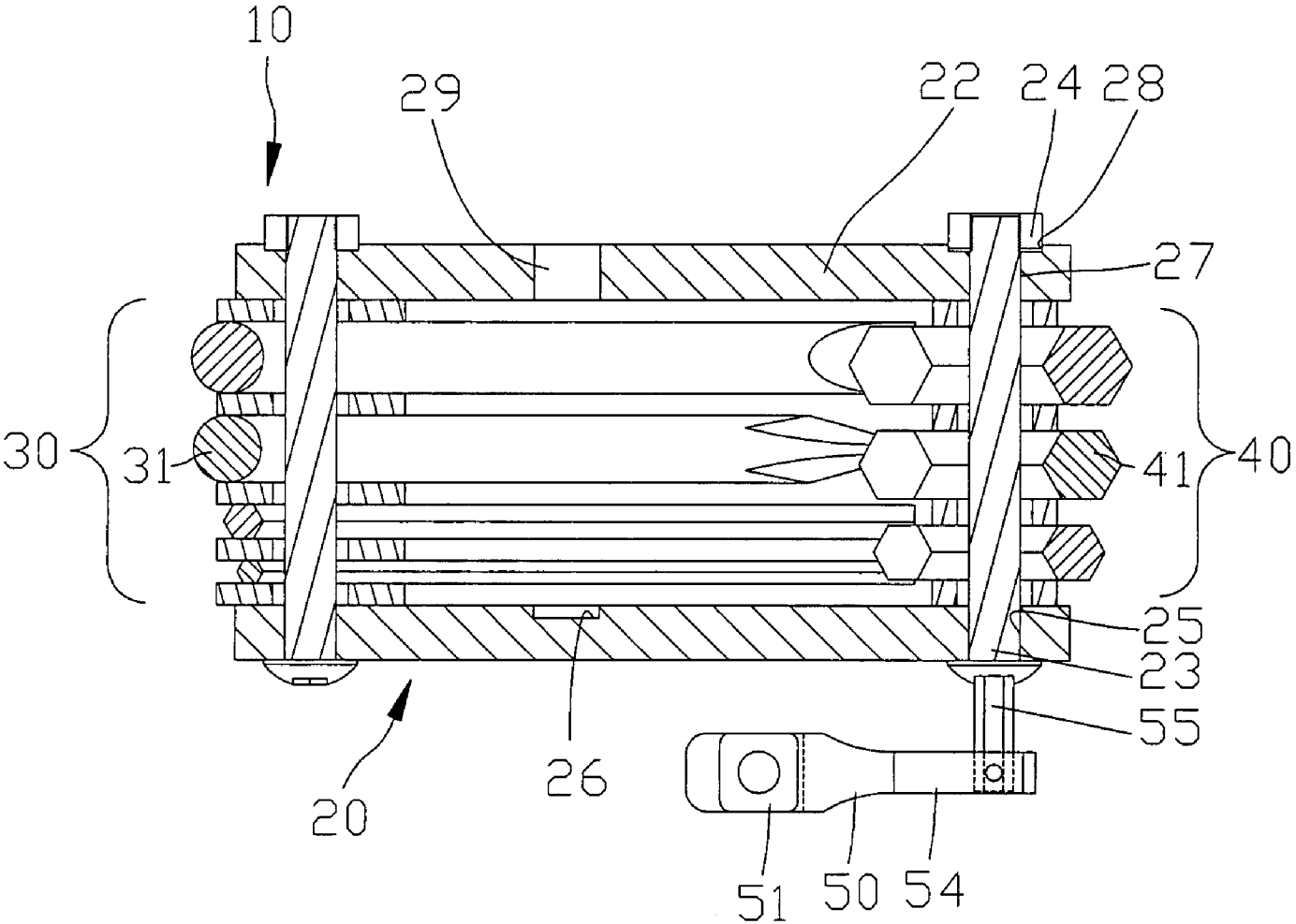
FIG. 6 is similar to FIG. 4 but shows the toolkit in another position.
Figure 7:
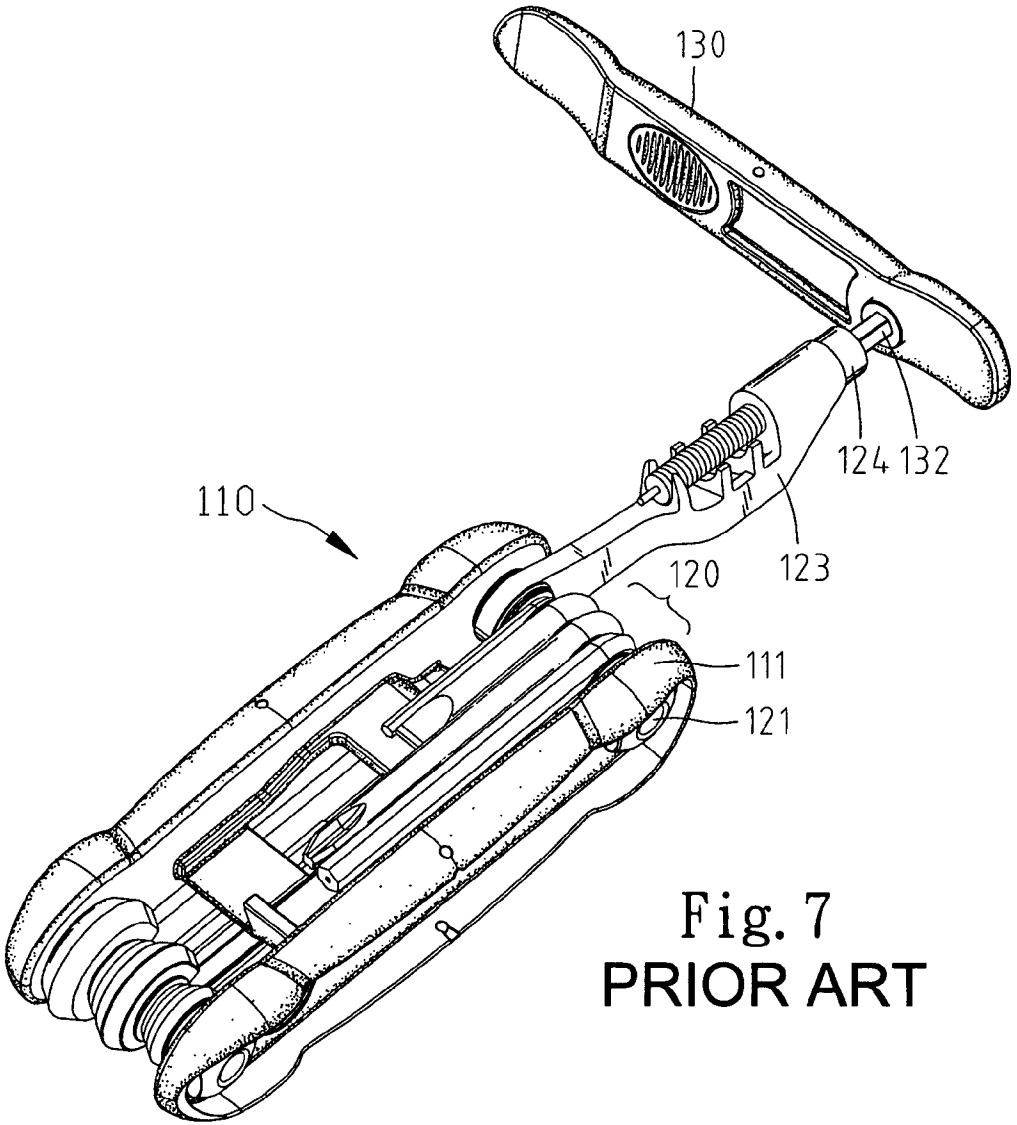
Fig. 7 PRIOR ART
FIG. 7 is a perspective view of a conventional toolkit that includes a chain tool for removing a pin from a link of a chain.

Referring to FIG. 6, after the toolkit 10 is used for some time, the bolts 23 tend to slack on the nuts 24. In this case, the Allen key 55 can be pivoted from the handle 54 and used to drive the bolts 23.

The toolkit 10 of the present invention possesses several advantages over the conventional toolkit discussed in Related Prior Art. Firstly, the chain tool supports the frame 20. Secondly, more tools can be attached to the bolts 23 since the chain tool is sandwiched between the first tool set 30 and the second tool set 40 instead of attached to the bolts 23 (FIG. 1). Thirdly, the chain tool can be taken from the frame 20 in order to reduce the total weight of the toolkit 10 if the chain tool is not to be needed.

The present invention has been described via detailed illustration of the preferred embodiment. Those skilled in the art can derive variations from the preferred embodiment without departing from the scope of the present invention. Therefore, the preferred embodiment shall not limit the scope of the present invention defined in the claims.

What is claimed is:

1. A toolkit comprising a frame, wherein the frame comprises a first lateral member, a second lateral member and two bolts provided between the first lateral member and the second lateral member; at least one tool set pivotally connected with one of the two bolts of the frame; and a chain tool is tightened and detachably attached to the frame intermediate the two bolts and between the first and second lateral members, wherein the chain tool is located in the frame in order to support the frame, wherein the first lateral member is kept from the second lateral member by the chain tool.

2. The toolkit according to claim 1 wherein the chain tool comprises a holder for holding a link of a chain and a screw installed on the holder in a rotational and movable manner for pushing a pin from the link of the chain, wherein the first lateral member is kept from the second lateral member by the holder.

3. The toolkit according to claim 2 further comprising an aperture having an annular periphery and formed in the second lateral member, wherein the screw can be driven in the holder through the aperture of the second lateral member and not removable from the holder when driven in the holder in order to keep the holder between the first lateral member and the second lateral member.

4. The toolkit according to claim 2 with the screw including a knob including multiple, radially extending lobes so as to be manually rotated, with the knob further including a recess for receiving a tool of the at least one tool set.

5. The toolkit according to claim 2 wherein the holder comprises a block formed thereon, wherein the first lateral member comprises a recess defined in a side for receiving the block when moved perpendicular to a plane including the two bolts.

6. The toolkit according to claim 5 further comprising an aperture having an annular periphery and formed in the second lateral member, wherein the screw can be driven in the holder through the aperture of the second lateral member and not removable from the holder when driven in the holder in order to keep the holder between the first lateral member and the second lateral member.

7. The toolkit according to claim 6 further comprising another tool set pivotally connected with the other of the two bolts of the frame, with the chain tool sandwiched between the at least one tool set and other tool set when the tool sets are pivoted about the bolts in a folded position.

8. The toolkit according to claim 7 wherein the chain tool comprises a driving element for driving the bolts.

9. The toolkit according to claim 1 wherein the frame comprises two nuts engaged with the bolts.

10. The toolkit according to claim 9 wherein the nuts are secured to the second lateral member.

11. The toolkit according to claim 10 wherein the second lateral member comprises two recesses defined in a side thereof, wherein the nuts are fit in the recesses.

12. The toolkit according to claim 10 wherein the chain tool comprises a driving element for driving the bolts.

13. The toolkit according to claim 12 wherein the driving element is pivotally connected with the chain tool.

14. The toolkit according to claim 1 further comprising another tool set pivotally connected with the other of the two bolts of the frame, with the chain tool sandwiched between the at least one tool set and the other tool set when the tool sets are pivoted about the bolts in a folded position.

15. A toolkit comprising a frame, a first tool set pivotally connected with the frame about a first axis, a second tool set pivotally connected with the frame about a second axis spaced from and parallel to the first axis, and a chain tool detachably attached to the frame, wherein the chain tool is sandwiched between the first tool set and the second tool set when the first and second tool sets are pivoted about the first and second axes in a folded position.

16. The toolkit according to claim 15 with the chain tool located intermediate the first and second axes when sandwiched between the first and second tool sets.

17. The toolkit according to claim 16 wherein the chain tool comprises a holder for holding a link of a chain and a screw installed on the holder in a rotational and movable manner for pushing a pin from the link of the chain, wherein the frame includes an aperture having an annular periphery, with the screw extending through the aperture and installed in the holder when the chain tool is sandwiched between the first tool set and the second tool set and not being removable from the aperture when installed in the holder.

18. A toolkit comprising a frame, wherein the frame comprises a first lateral member, a second lateral member and a bolt provided between the first lateral member and the second lateral member; a tool set pivotally connected with the bolt of the frame; and a chain tool for pushing a pin from a link of a chain, with the chain tool detachably attached to the frame between the first and second lateral members, wherein the chain tool comprises a driving element for driving the bolt, wherein the driving element is pivotally connected with the chain tool.

19. The toolkit according to claim 18 wherein the chain tool is located in the frame in order to support the frame when attached to the frame.

20. The toolkit according to claim 18 further comprising another bolt provided between the first and second lateral members and spaced from the first bolt; and another tool set pivotally connected to the other bolt; and wherein the chain tool is sandwiched between the tool set and the other tool set when pivoted about the bolts into a folded position.

* * * * *